US012780508B1

(12) United States Patent
Neupane

(10) Patent No.: US 12,780,508 B1
(45) Date of Patent: Nov. 3, 2026

(54) MULTI-FUNCTION LID

(71) Applicant: Bishal Neupane, Seattle, WA (US)

(72) Inventor: Bishal Neupane, Seattle, WA (US)

( * ) Notice: Subject to any disclaimer, the term of this patent is extended or adjusted under 35 U.S.C. 154(b) by 0 days.

(21) Appl. No.: 19/236,618

(22) Filed: Jun. 12, 2025

(51) Int. Cl.
*B65D 47/08* (2006.01)
*B65D 51/22* (2006.01)

(52) U.S. Cl.
CPC ..... *B65D 47/0857* (2013.01); *B65D 51/222* (2013.01)

(58) Field of Classification Search
CPC ..... B65D 75/5861; B65D 51/2814; B65D 51/227; B65D 51/226; B65D 51/221; B65D 51/22; B65D 47/06; B65D 47/08; B65D 47/0857; B65D 51/222
See application file for complete search history.

(56) References Cited

U.S. PATENT DOCUMENTS 955,908 A * 4/1910 Ross ..... B65D 47/0847 220/254.2
3,927,794 A * 12/1975 Erdman ..... B65D 17/401 222/541.6
5,415,312 A * 5/1995 Mueller ..... B65D 47/089 222/545
2003/0052126 A1* 3/2003 Zettle ..... B65D 43/0212 220/714
2005/0045634 A1* 3/2005 Ward ..... A47G 19/2272 220/254.3
2007/0164027 A1* 7/2007 Auer ..... B65D 47/0847 220/784
2007/0278257 A1* 12/2007 Antal ..... B65D 5/706 222/535
2010/0213221 A1* 8/2010 Vogel ..... B65D 47/0895 222/505
2015/0150395 A1* 6/2015 George ..... A47J 41/0022 220/254.5
2016/0016698 A1* 1/2016 Giraud ..... B65D 43/0202 220/254.3

* cited by examiner

*Primary Examiner* — Kareen K Thomas
(74) *Attorney, Agent, or Firm* — Davis Wright Tremaine LLP

(57) ABSTRACT

A multi-function lid for use with a container to transform the container into a container with multiple functions. The lid may be fabricated using materials made from food-grade materials with polymeric elastomeric properties. The lid features a cutout that aligns with existing container spouts for larger pours and a pointed section that creates an opening in the container for shaker use. The lid is configured to allow for precise dispensing, while its moisture-proof design prevents dispensing objects from clumping. The lid may be configurable to switch between the shaker and metal spout, thus addressing the need for both large and precise dispensing.

20 Claims, 8 Drawing Sheets

MULTI-FUNCTION LID

FIELD OF THE INVENTION

The present disclosure relates to a lid for containers configured to dispense substances. In particular, it relates to a lid having a multi-function purpose.

BACKGROUND

Salt canisters or canisters, in general, used to hold different seasonings are a staple in kitchens. These canisters, typically made of cardboard, are sold by various brands. Despite the variety of brands, the canisters share the same material, dimensions, and dispensing mechanism-a metal spout designed for pouring larger quantities of salt. While the metal spout is effective for dispensing larger amounts, improvements to achieve precise seasoning can be made.

DETAILED DESCRIPTION

Figure 1:
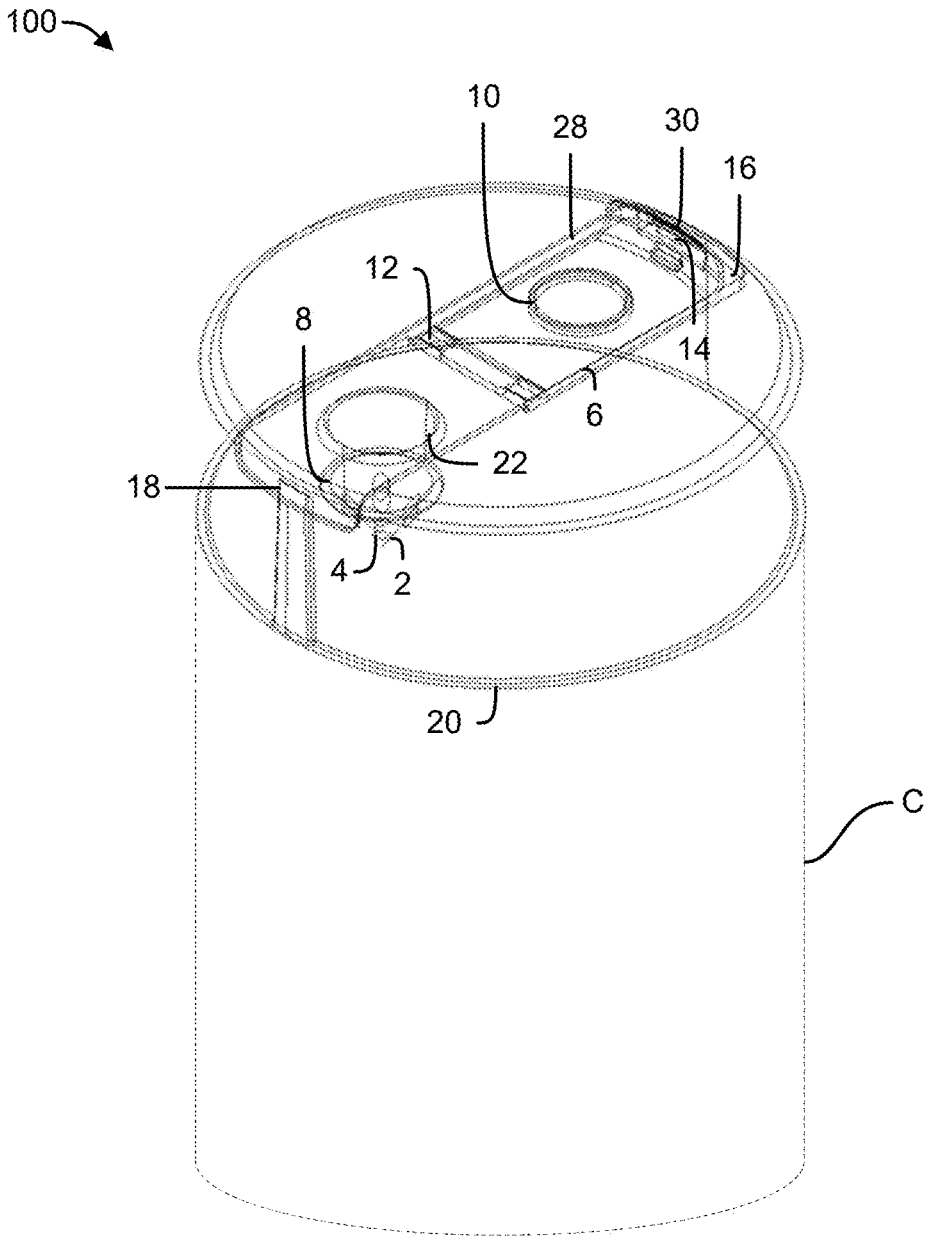
FIG. 1 is a perspective view of a lid with a multi-function purpose in open position.

FIG. 1 illustrates a perspective view of a multi-function lid 100 depicted in its shaker configuration. When in shaker configuration, the multi-function lid 100 may transform a standard 26 oz container, referred to as container C, into a shaker or a large pour container. While salt is traditionally used to dispense from the standard 26 oz container, it may be understood that the multi-function lid 100 can be modified to transform any container similar to the container C to dispense any type of substance. The multi-function lid 100 comprises several key components that work in concert to achieve this functionality. In an example embodiment, the multi-function lid 100 is a functional lid configured to be quickly deployed and used as a functional lid for the container C of its user's choosing. Once deployed, the multi-function lid 100 may be used (e.g., by the user) to dispense a smaller quantity (e.g., by shaking) of a substance from the container C. The container C traditionally comprises a built in spout for pouring substances in large quantities. The multi-function lid 100 may transform the container C into a shaker while retaining the option to use the spout for larger pours.

A first portion of the multi-function lid 100 may include, but is not limited to, a lid track 28, a snap cover 6, a living hinge 12, snap tab 14, a snap lock 18, a notch 30, and a conical tip cylinder 2, among other components not shown for clarity. The lid track 28, may be a central track, groove, and/or other component for housing the rotatable snap cover 6, allowing transitions between configurations. In an example embodiment, the snap cover 6 may alternatively be configured as a flip lid, cover flap, a closure cap or any other structure configured to perform a substantially similar function, such as providing a cover. In at least one embodiment, the lid track 28 has a first portion with the rotatable snap cover 6 and the notch 30. The notch 30 may alternatively be configured as a thumb tab, finger lift, lift tab, pull tab, or any other structure configured to perform a substantially similar function, such as facilitating manual engagement or manipulation of the multi-function lid 100 (e.g., lifting the snap cover 6). The snap cover 6 can connect to the living hinge 12, with the sides of the living hinge 12 attached to each side of the lid track 28. For example, the snap cover 6 may function as a pivotable component, capable of rotating using the living hinge 12 between a first configuration, such as a closed position (e.g., in a partially closed position or a fully closed position), and a second configuration, such as an open position (e.g., in a partially open position or a fully open position). In an example embodiment illustrated in FIG. 1, the living hinge 12 is a flat-type that is integrated into the multi-function lid 100 using injection molding techniques. The injection molding techniques can include standard injection molding, overmolding, insert molding, gas-assisted injection molding, co-injection molding, micro injection molding, reaction injection molding (RIM), thin-wall injection molding, cube molding, and liquid silicone rubber (LSR) molding. The injection molding techniques can be performed using one of many food-grade materials, including certain thermoplastics like polyethylene and polypropylene, elastomers such as silicone and specific thermoplastic elastomers (TPE), as well as stainless steel and properly glazed ceramics, wood-plastic composites, and/or food-safe composites that behave like thermoplastics. A food-safe composite can be a material that is approved by a regulatory body, such as the Food and Drug Administration (FDA) in the United States, the European Union Food Contact Materials Regulation (EC), NSF International (NSF), or the International Organization for Standardization (ISO) standards, and must comply with migration testing, Good Manufacturing Practices (GMP), and be free from harmful chemicals like Bisphenol A (BPA) and phthalates. In another example embodiment, the multi-function lid 100 can be manufactured using three-dimensional (3D) printing techniques. The 3D printing techniques can use the food-safe composite materials described herein.

In an example embodiment, not illustrated, the living hinge 12 may alternatively be configured as a butterfly style, bi-stable style, similar style hinge, or any other structure configured to perform a substantially similar function, such as a structure that is capable of rotating. In another example embodiment, the living hinge 12 can be connected using metal pins and joints to allow the snap cover 6 to rotate between configurations. In another example embodiment, the snap cover 6 can be connected using one or more different types of hinges, such as pivot hinges, mechanical hinges. A living hinge can be a flexible, integrally molded hinge designed for repeated bending and rotation. A pivot hinge (e.g., axial hinge) can be a type of hinge comprising a pin or axial for rotational movement(s). A mechanical hinge can be a hinge assembled from a plurality of parts designed for pivoting, rotating, and/or folding.

In an embodiment, the notch 30 is positioned adjacent or connected to the snap lock 18. The snap lock 18 may alternatively be configured as a snap recess, a snap seat, or any other structure configured to perform a substantially similar function, such as housing the snap cover 6 and/or the snap tab 14. The snap tab 14 can be configured to fit securely (e.g., by clicking, locking, etc.) into the snap lock 18. In at least one embodiment, the snap tab 14 and snap lock 18 allow the snap cover 6 to be locked into the closed position. The snap tab 14 may be alternatively be configured as a locking tab, or any other structure configured to perform a substantially similar function, such as securing a part in a position. The notch 30 can be used, when pulled and/or pushed upward, to release the snap cover 6 from the closed position. For example, the user can apply a pulling or pushing force on the notch 30 to disengage the snap cover 6 and snap tab 14 from the snap lock 18, facilitating the transition between configurations. In at least one embodiment, in the open position, the multi-function lid 100 exposes a shaker opening 22. The shaker opening 22 may alternatively be configured as a discharge opening, dispensing port, dispensing hole, dispensing aperture, or any other structure configured to perform a substantially similar function, such as facilitating pouring a substance from the multi-function lid 100. The open configuration can be enabled by unclicking (e.g., unlocking, disconnecting, opening, etc.) the snap cover 6 from the snap lock 18.

In another example embodiment, the lid track 28 has a second portion with a cutout (e.g., opening) exposing space 16. The second portion of the lid track 28 may align with the built in spout of the container C. In at least one embodiment, the closed position enables the second portion of the multi-function lid 100 to be used. In another example embodiment, the second portion of the multi-function lid 100 may be used in the open position (e.g., partially opened). The closed position can be enabled by rotating the snap cover 6 to engage with (e.g., latch into) the snap lock 18. In another example embodiment, in the closed position, the shaker opening 22 is protected from outside materials from entering, and the user can access the built in spout. Thus, the multi-function lid 100 reduces the cost of purchasing multiple containers for different purposes and the space used to store multiple containers in the owner's space.

To deploy the multi-function lid 100, a user may position a round base 20 of the multi-function lid 100 on top of the container C, aligning the round base 20 with a round top of the container C. Once aligned, the user may push the multi-function lid 100 down onto the container C to create a friction fit into the container C. In an example embodiment, FIG. 1 illustrates that the multi-function lid 100 is a friction fit. For example, the friction fit can include the multi-function lid 100 being pressed onto the container C's rim to form a tight seal, which can prevent accidental detachment during use. In another example embodiment, the container C can be a container with a threaded neck or a snap-fit design. A threaded neck design can be a helical structure on the container's neck that allows a lid, such as the multi-function lid 100, to be twisted on securely to provide a seal that is resistant to leaks. A snap-fit design can include interlocking features on a container, such as the container C, that can be snapped together with a lid comprising an interlocking feature, such as the multi-function lid 100. The multi-function lid 100 can be manufactured to be compatible with the threaded neck design and/or the snap-fit design.

The push action can form an opening 8 into the container C and can cause secure attachment of the multi-function lid 100 on top of the container C. In an embodiment, the attachment modifies the container C to enable multiple uses, including use as a shaker or in the container C's standard (e.g., default) configuration. The opening 8 in the container may also be referred to as a hole or puncture. The conical tip cylinder 2 can be positioned to cut the opening 8 into the container C opposite from the spout. The spout (not shown for clarity) may be found in space 16, for example under a snap cover 6 when in the open configuration, or in space 16 when in the closed position. The opening 8 allows for precise dispensing through holes 4 located in the conical tip cylinder 2 for facilitating flow and exit of the substance. For example, the container may contain a food seasoning substance, such as salt, and the user may prefer to shake salt from the container instead of pour from the large metal spout, so the user may deploy the lid 100 to transition between shaker and pour function. In at least one embodiment, the conical tip cylinder 2 and the holes 4 are positioned inside the container C and angled to prevent environmental elements, such as steam from a boiling pot of water, from entering the container C when using shaker mode. In the embodiment illustrated, the conical tip cylinder 2 is positioned to optimize the flow of the substance while minimizing the container C's exposure to external elements. When the owner is done using the shaker function, the owner can close the snap lid 6 to cover the opening 8.

To transform the multi-function lid 100 into storage mode or standard use mode, the snap cover 6 may be used to cover the opening 8, causing the holes 4 to be covered. The snap cover 6 can be designed to click into snap lock 18, ensuring secure closure and preventing moisture ingress. The snap tab 14 may be configured to engage with the snap lock 18, thereby reinforcing the snap cover 6 retention in the closed position. A closure lip 10 formed on the snap cover 6 can be configured to engage with a shaker opening 22. In the closed position, the closure lip 10 may be locked into shaker opening 22, thereby tightly covering the opening 8 to prevent moisture from entering the container C. The closure lip 10 may take the form of various structures, including but not limited to a closure ridge, guide tab, or seal collar. The shaker opening 22 may take the form of various structure, including but not limited to a discharge opening or dispensing hole. A living hinge 12 allows the snap cover 6 to pivot and snap into snap lock 18, providing ease of use and durability.

In the embodiment illustrated, the snap cover 6 is illustrated in the open position. However, in alternate embodiments, the snap cover 6 can be in the closed position. In closed position, the space 16 of the multi-function lid 100 exposes the spout (not shown for clarity) to allow users to switch between the shaker function and spout function. When in closed position, the user may choose to use the spout or store the container C altogether. When the multi-function lid 100 is in closed position, the container C can be sealed, and the substance inside may be protected, allowing the container C to be stored at the owner's choosing.

Referring to FIGS. 1-7, there is shown a multi-function lid 100 (or lid 100), which illustrates the preferred embodiment. Lid 100 can be used with a container C containing a substance, and which comprises a round base 20 (or base 20), a sidewall having an inner surface which extends upwardly from the base 20, which extends along the circumference of the top of the container C. In an embodiment not illustrated, the lid 100 can be configured as a two-component system, incorporating multiple materials to enhance functionality and durability, such as an adjustable dispensing option while maintaining the same conical tip cylinder form. For example, the two-component design can include a primary lid structure that is similar to the multi-function lid 100 described herein, and a secondary component that provides additional features, such as adjustable dispensing holes or sealing capabilities. In an embodiment, the secondary component can be configured with multiple dispensing options (e.g., different shapes and sizes of dispensing holes) and rotate around the primary lid structure to adjust dispensing functions. The two-component system can be adapted to fit various types of containers, including those with threaded necks, or snap-fit designs.

Figure 2:
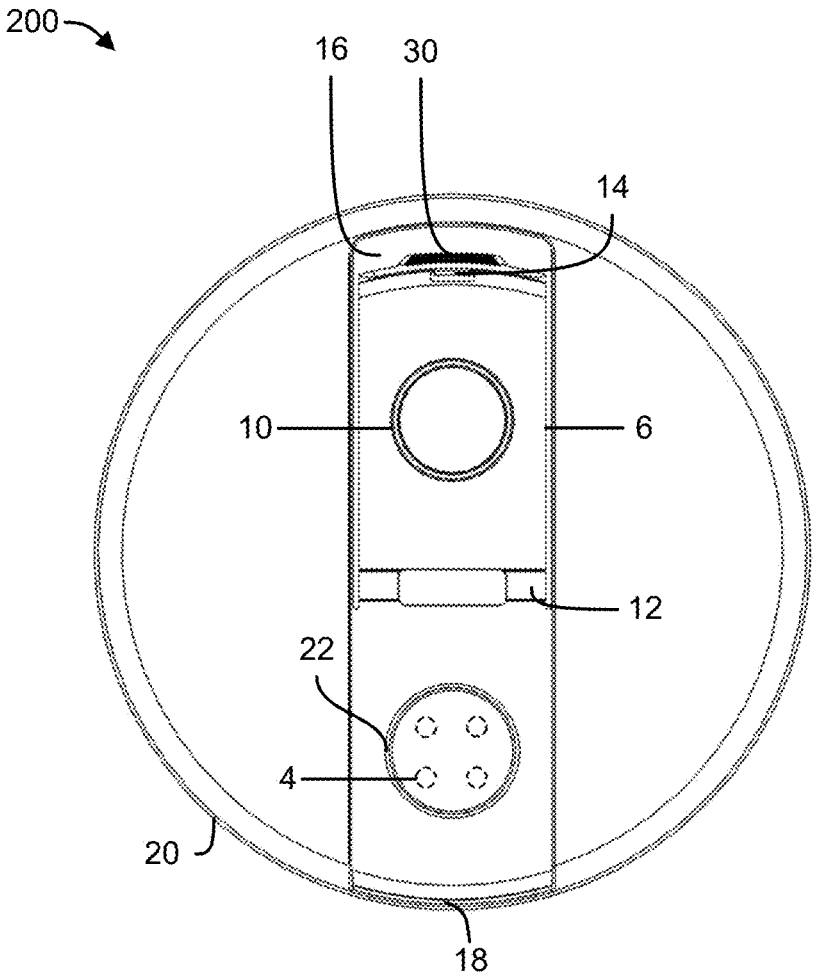
FIG. 2 is a top view of the lid with a multi-function purpose.

Referring now to FIG. 2, a top view 200 of the multi-function lid 100 is depicted in open position. The top view 200 illustrates the layout of the of the shaker opening 22 opposite the spout (not shown for clarity) in space 16. In an embodiment, the snap cover 6, the snap tab 14, the snap lock 18, the closure lip 10, the notch 30, and the shaker opening 22 may operate as described herein in connection with FIG. 1. The multi-function lid 100 can be designed to be reusable and may be manufactured from food-grade materials such as polypropylene or stainless steel, ensuring safety and durability. In at least one embodiment, the multi-function lid 100 is reusable, offering an eco-friendly and long-lasting solution, and its unique design may be easy to manufacture, making it cost-effective for production. The position of the shaker opening 22 opposite the spout is part of a symmetrical design that may contribute to the multi-function lid's 100 balanced appearance and functionality. In an embodiment, the round base 20 is the foundation for the multi-function lid 100 and aligns with the container C (illustrated in FIG. 1) built in spout, providing structural integrity and ensuring a secure fit onto the container C.

Figure 3:
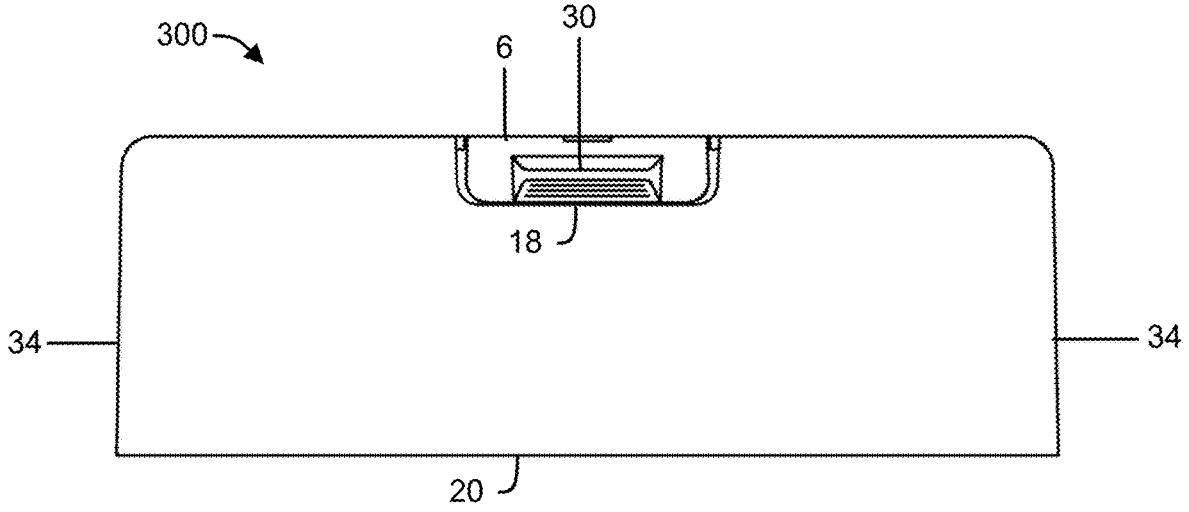
FIG. 3 is a front elevational view of the lid with a multi-function purpose in closed position.

Referring now to FIG. 3, a front elevation view 300 of the multi-function lid 100 is depicted with the snap cover 6 in closed position. The snap tab 14 (see FIGS. 1-2) may be engaged with snap lock 18. The round base 20 may fit securely around the container C (illustrated in FIG. 1), creating a tight seal and preventing moisture ingress. In at least one embodiment, the multi-function lid 100 has circumferential sidewall 34 extending upwardly from a peripheral edge of the base 20. In an embodiment, the circumferential sidewall 34 is circular in shape. In other embodiments, the circumferential sidewall can have an oval, elliptical, or polygonal configuration. The circumferential sidewall 34 can be configured to create a secure fit between the lid and the container C. The secure fit can allow the container C to be used for multiple purposes, such as shaking or large-volume dispensing of a substance, without leakage or spillage. The secure fit can ensure that the multi-function lid 100 remains firmly attached during use, preventing accidental detachment. Thus, the multi-function lid 100 can be configured to prevent moisture ingress and reduce the likelihood of substance clumping, maintaining the container's functionality across a range of environmental conditions.

Figure 4:
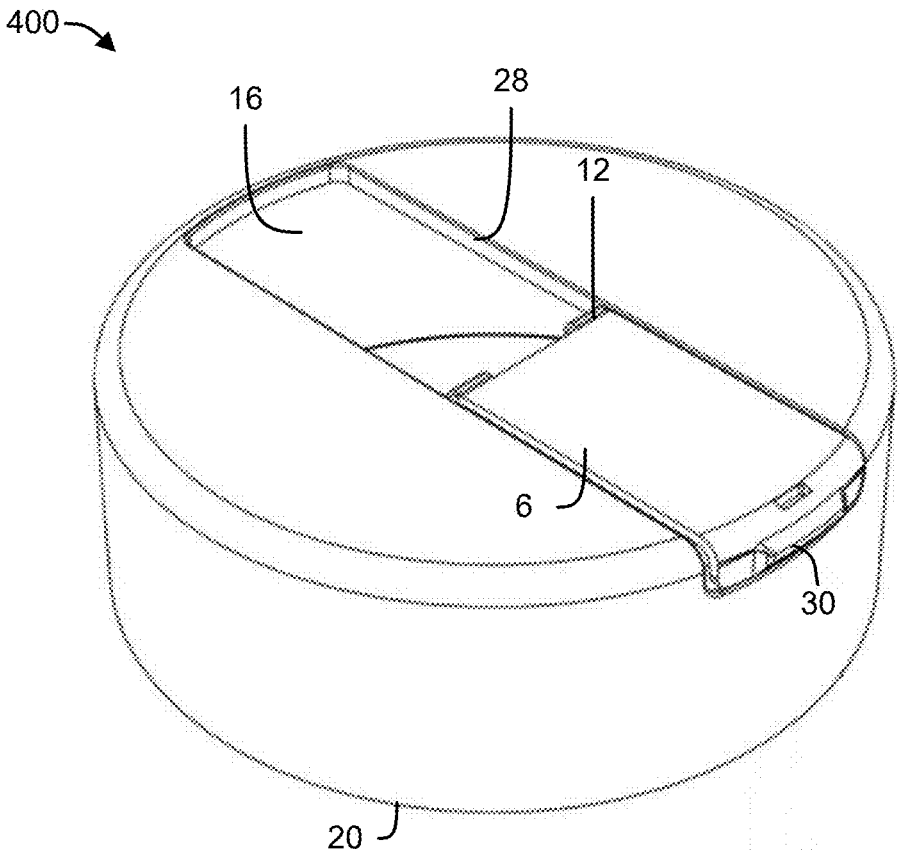
FIG. 4 is a perspective view of the lid with a multi-function purpose illustrating a cover in closed position.

Referring now to FIG. 4, a perspective view 400 of the multi-function lid 100 with the snap cover 6 in the closed position (e.g., the first configuration) is depicted. FIG. 4 illustrates the snap cover 6 covering the shaker opening 22 (see FIGS. 1-2), secured by the snap lock 18 (see FIGS. 1-2). The snap cover 6 can be connected to the living hinge 12, allowing the snap cover 6 to pivot between open and closed positions. The living hinge 12 can be a flexible junction that delineates the first portion of the lid track 28 from the section portion.

In an embodiment, the first portion of the lid track 28 can include the rotatable snap cover 6 that features the snap tab 14 (see FIGS. 1-2) designed to engage with snap lock 18, and the notch 30 located adjacent to the snap lock 18. The notch 30 can be a bump mechanism for the user to apply a pulling or pushing force to release the snap cover 6 from the snap lock 18, allowing the transition to an open position (e.g., the second configuration).

In another embodiment, the second portion of the lid track 28 includes a cutout space 16 that aligns with the built-in spout of the container C (see FIG. 1) when the snap cover 6 is in the closed position.

Figure 5:
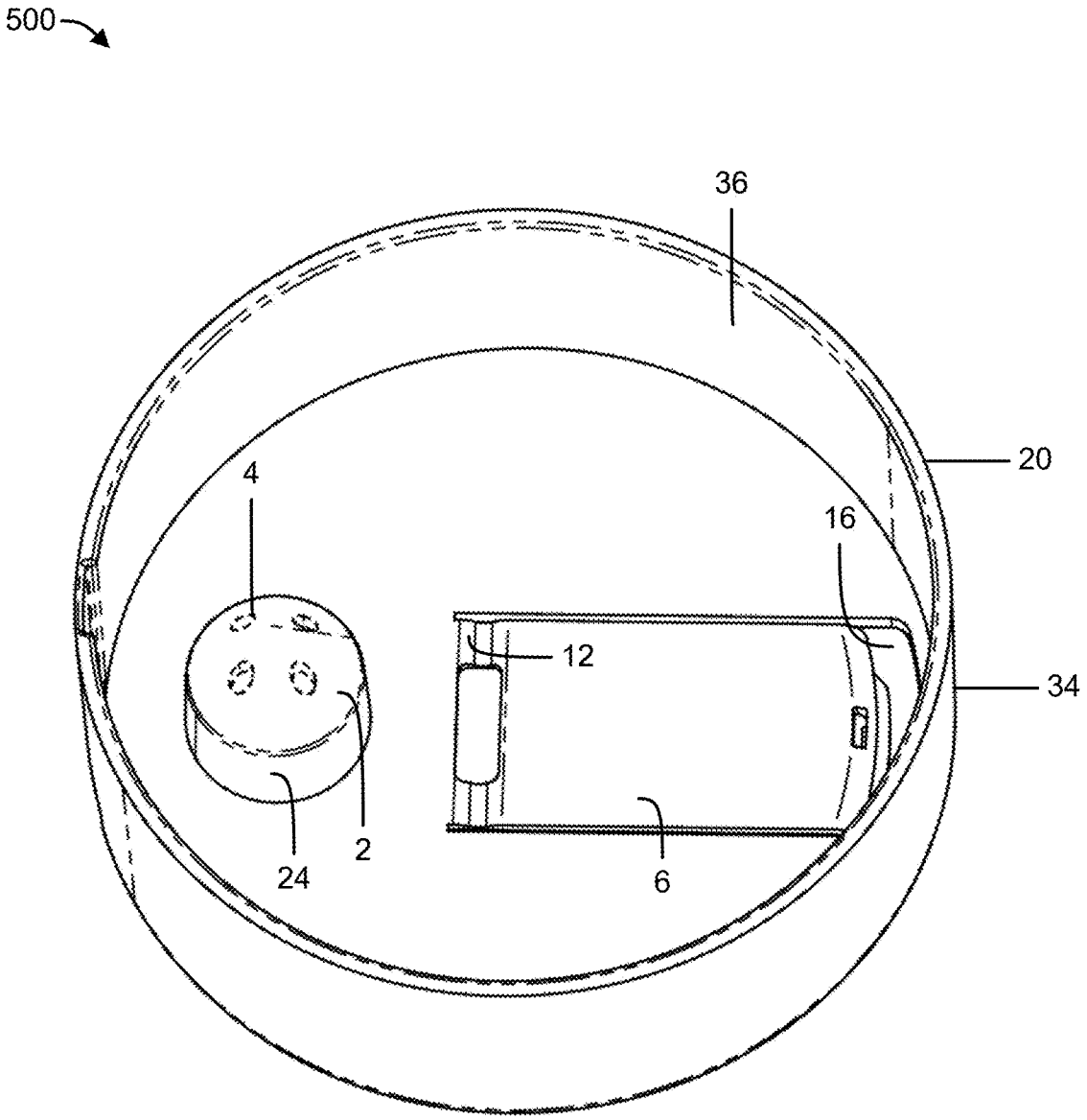
FIG. 5 is a bottom perspective view of the lid with a multi-function purpose illustrating a conical tip cylinder component.
Figure 6:
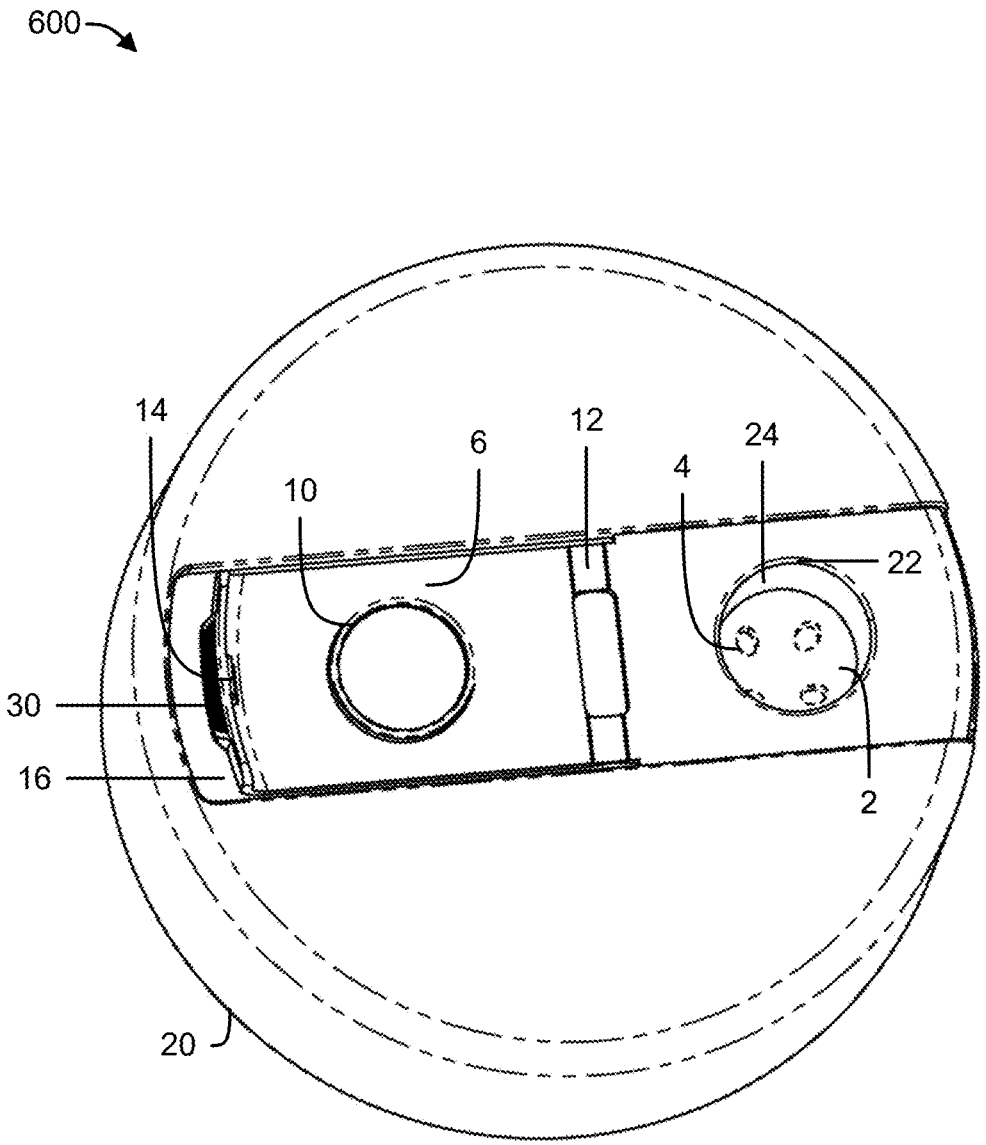
FIG. 6 is a top perspective view of the lid with a multi-function purpose illustrating a dispensing opening and a cover.
Figure 7:
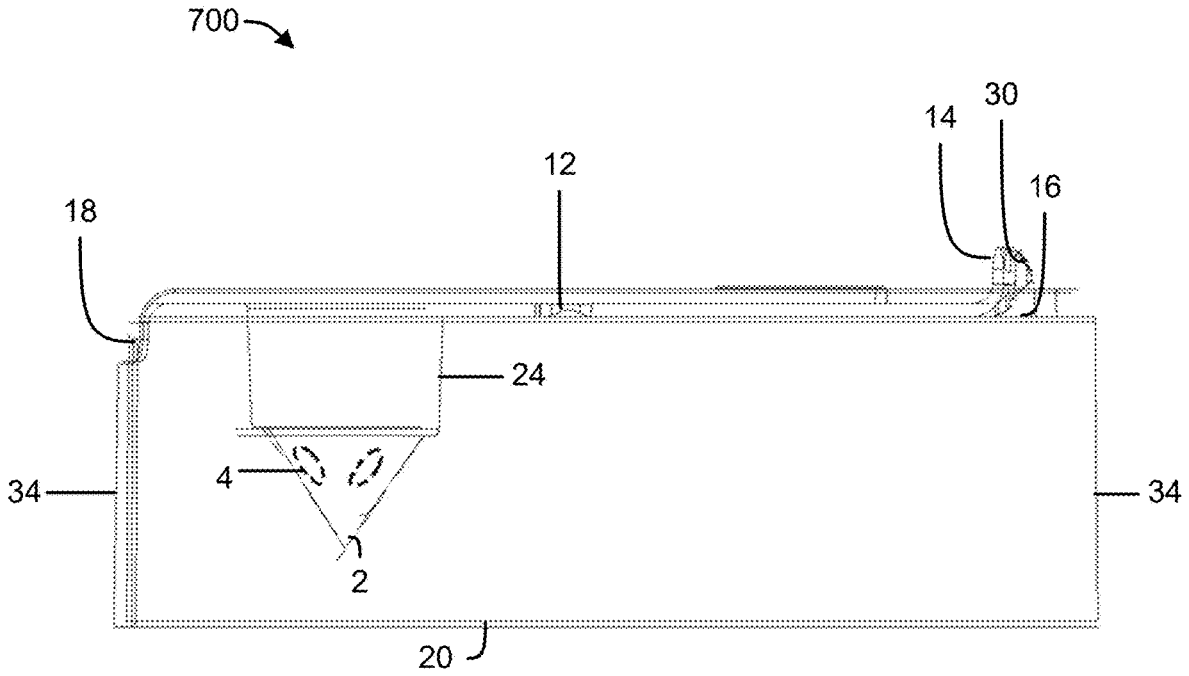
FIG. 7 is a side elevational view of the lid with a multi-function purpose illustrating a conical tip cylinder component.

Referring now to FIGS. 5-7, views of the multi-function lid 100, depicting the conical tip cylinder 2 configuration are illustrated. The conical tip cylinder 2 may be configured to penetrate cardboard or other materials having comparable penetrable characteristics. In some embodiments, the tip may be adapted for compatibility with other materials, including but not limited to plastic, used in various structure or enclosures. The conical tip cylinder 2 can be a cylindrical body with a conical top and/or other shapes, such as square, rectangular, or other polygonal shapes with a conical or functionally similar tip. A height of the conical tip cylinder 2 can be sized to prevent the holes 4 from being obstructed by the container C material, such as cardboard burrs created during the deployment of the multi-function lid 100. For example, the conical tip cylinder 2 can create an opening in the container C with uneven edges, such as an opening located in the area of the shaker opening 22, and to avoid these uneven edges from obstructing the holes 4, the conical tip cylinder 2 is dimensioned to position the holes beyond the location of the uneven edges. In at least one embodiment, the uneven edges can be a cardboard burr, such as a drilling burr. Reference numerals similarly used in connection with FIGS. 1-4 are employed. The holes 4 can be positioned to allow the substance to flow through and out of the holes 4 when the container C (illustrated in FIG. 1) is tilted. For example, the holes 4 can be located on the conical (e.g., angled) position of the conical tip cylinder 2, to avoid obstruction caused by cardboard burrs. The substance may flow from the holes 4 through the chamber 24 that is connected to the conical tip cylinder 2. The chamber 24 may be positioned inside the container C once the multi-function lid 100 is deployed, providing precise and controlled dispensing. The chamber 24 may direct flow of substances from the container through the shaker opening 22. In at least one embodiment, the chamber 24 is a protruding chamber located inside the container C once the multi-function lid 100 is deployed. Thus, the multi-function lid 100 provides a controlled dispensing mechanism.

The multi-function lid 100 material may be designed to be moisture-proof, preventing salt clumping and maintaining usability in various conditions, such as an environment with moisture. In at least one embodiment, the conical tip cylinder 2 is configured to puncture the container C such that the conical tip cylinder 2 is located inside of the container C when the multi-function lid 100 is deployed. In an embodiment, as a result of the conical tip cylinder 2 being located inside the container C, the holes 4 are also located inside the container C. This design prevents moisture from directly contacting the holes 4 when using the lid 100 in open position to dispense the substance from the container C. The orientation of opening 8, created in the container by the conical tip cylinder 2, is strategically positioned relative to shaker opening 22, where the snap cover 6 may fold over via the living hinge 12 and snaps into place to cover the opening 8 securely. This design may seal the container C when not in use, preventing moisture ingress and maintaining the freshness of the container C contents. Thus, the multi-function lid 100 can prevent the substance, such as salt, from clumping and without compromising the shaker function.

The multi-function lid 100 may be adaptable to multiple brands, enhancing its market applicability and user convenience.

An inner surface 36 of the circumferential sidewall 34 may be a smooth surface. In an embodiment, the inner surface 36 can be roughened, incorporate molded ribs, knurling, or other textured patterns formed along one or more portions of the inner surface 36. For example, the inner surface 36 can be configured to improve the frictional engagement between the multi-function lid 100 and a complementary surface, such as the container C, thereby improving the stability of the connection and reducing likelihood of unintentional dislodgement, loosening, or damage during use or handling. In an embodiment, a selection, arrangement, and extent of the inner surface 36 configuration can be adjusted based on material properties, application requirements, and/or manufacturing considerations.

Figure 8:
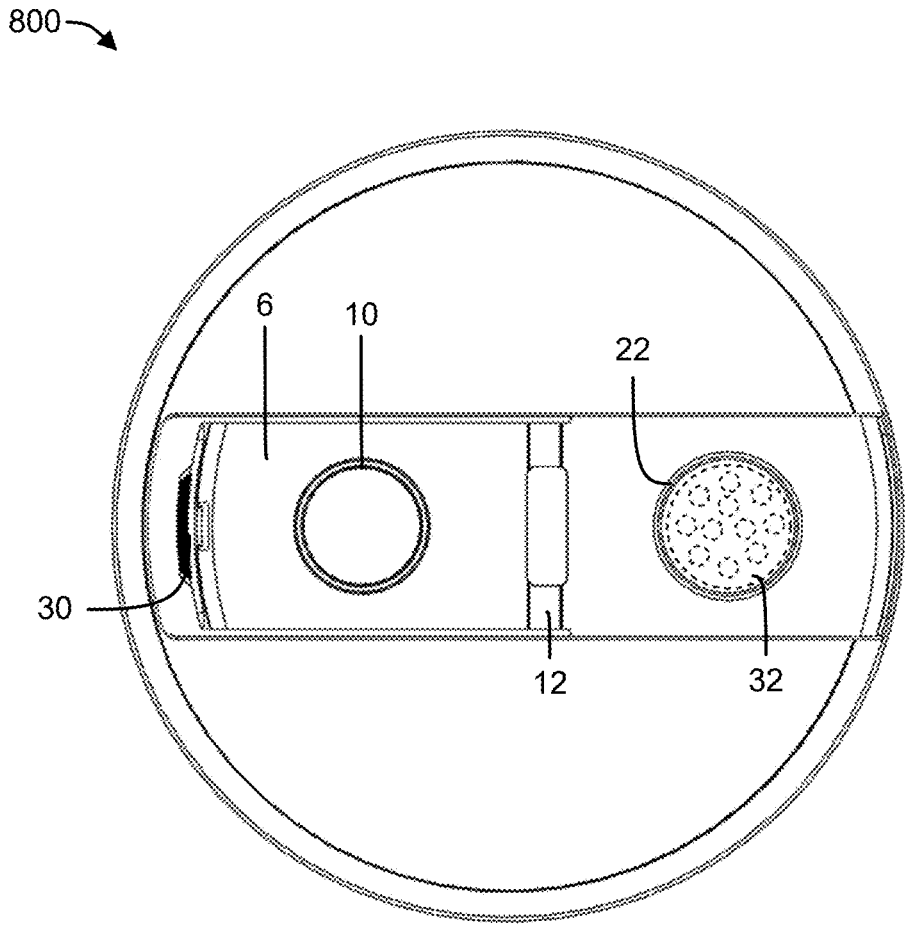
FIG. 8 is a top view of the lid with a multi-function purpose illustrating an interchangeable disc.

Referring now to FIG. 8 is a top view 800 of the multi-function lid 100 illustrating an interchangeable disc 32. The interchangeable disc 32 can be positioned within the shaker opening 22. In an embodiment, the interchangeable disc 32 is configured with a smaller holes compared to the holes 4 (see FIGS. 1-2 and FIGS. 5-7) in the conical tip cylinder 2 (see FIGS. 1-2 and FIGS. 5-7). The number of holes in the interchangeable disc 32 can vary, with examples including configurations of 4, 6, 8, or more or less, depending on a desired dispensing rate. The holes can be configured in different ways, such as evenly spaced around the interchangeable disc 32, clustered on one side of the interchangeable disc 32, or arranged in a pattern that is compatible with specific dispensing needs. The size of the holes can be determined using standard substance sizing, such as standard seasoning measurements for salt, pepper, and/or other substances.

For example, the interchangeable disc 32 can be configured with holes sized for a plurality of substances, such as finely ground or power-like substances (e.g., popcorn salt or flour). In another example, the interchangeable disc 32 dispensing holes can be adjusted using an adjustment mechanism. The adjustment mechanism can be a plus sign design, or similar style that can facilitate twisting the interchangeable disk 32 to adjust the size of the holes exposed. In at least one embodiment, the interchangeable disk 32 can be adjusted to a half open position, a fully open position, a closed position, or a customized position. The adjusted position can correspond to an amount of substance that can dispensed via the interchangeable disk 32.

In an embodiment, the interchangeable disc 32 can be secured into place using a friction-fit or snap-fit mechanism, allowing users to swap the interchangeable disc 32. For example, the friction fit mechanism can be deployed by pressing the interchangeable disk 32 into the shaker opening 22, creating a tight seal. In another example, the snap-fit mechanism can include interlocking features to hold the interchangeable disk 32 securely in place. The user can deploy the interchangeable lid 32 to facilitate dispensing of a substance with a particular texture, size, and/or type of substance.

The foregoing described embodiments depict different components contained within, or connected with, different other components. It is to be understood that such depicted architectures are merely exemplary, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected," or "operably coupled," to each other to achieve the desired functionality.

While particular embodiments of the present disclosure have been shown and described, it will be obvious to those skilled in the art that, based upon the teachings herein, changes and modifications may be made without departing from this disclosure and its broader aspects and, therefore, the appended claims are to encompass within their scope all such changes and modifications as are within the true spirit and scope of this disclosure. Furthermore, it is to be understood that the disclosure is solely defined by the appended claims. It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to disclosures containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations).

Conjunctive language, such as phrases of the form "at least one of A, B, and C," or "at least one of A, B and C," (i.e., the same phrase with or without the Oxford comma) unless specifically stated otherwise or otherwise clearly contradicted by context, is otherwise understood with the context as used in general to present that an item, term, etc., may be either A or B or C, any nonempty subset of the set of A and B and C, or any set not contradicted by context or otherwise excluded that contains at least one A, at least one B, or at least one C. For instance, in the illustrative example of a set having three members, the conjunctive phrases "at least one of A, B, and C" and "at least one of A, B and C" refer to any of the following sets: {A}, {B}, {C}, {A, B}, {A, C}, {B, C}, {A, B, C}, and, if not contradicted explicitly or by context, any set having {A}, {B}, and/or {C} as a subset (e.g., sets with multiple "A"). Thus, such conjunctive language is not generally intended to imply that certain embodiments require at least one of A, at least one of B, and at least one of C each to be present. Similarly, phrases such as "at least one of A, B, or C" and "at least one of A, B or C" refer to the same as "at least one of A, B, and C" and "at least one of A, B and C" refer to any of the following sets: {A}, {B}, {C}, {A, B}, {A, C}, {B, C}, {A, B, C}, unless differing meaning is explicitly stated or clear from context.

Accordingly, the disclosure is not limited except as by the appended claims.

What is claimed is:

1. A multi-function lid, comprising:

a circular base and a central track;

a first portion of the central track comprising:

a protruding chamber, wherein the protruding chamber comprises a conical tip cylinder having a plurality of dispensing openings;

a snap cover with a living hinge having ends connected to each side of the central track, wherein the snap cover comprises a locking mechanism configured to connect the snap cover with the multi-function lid in a closed position; and a second portion of the central track comprising an opening.

2. The multi-function lid of claim 1, wherein the second portion aligns with a built in spout of a container.

3. The multi-function lid of claim 1, wherein the circular base is configured to be coupled securely onto a round container.

4. The multi-function lid of claim 1, wherein the multi-function lid comprises a first configuration to perform a shaker function using the first portion of the central track of the multi-function lid.

5. The multi-function lid of claim 1, wherein the multi-function lid comprises a second configuration to perform a traditional use of a container using the second portion of central track of the multi-function lid.

6. The multi-function lid of claim 1, wherein the multi-function lid is configured to transform a standard 26 oz salt cardboard canister into a shaker and pour dispenser.

7. The multi-function lid of claim 1, wherein the plurality of dispensing openings are located at the end of the protruding chamber that when connected to a canister enables the multi-function lid to be used in a shaker mode.

8. The multi-function lid of claim 1, wherein the snap cover comprises a notch configured to release the snap cover from the closed position.

9. The multi-function lid of claim 1, wherein the conical tip cylinder is configured to puncture a container to cause contents of the container to be dispensed in a shaker mode.

10. A lid for a container, comprising:

a base with a central track removably coupled to a top of the container;

a first portion of the central track comprising:

a protruding chamber, wherein the protruding chamber comprises a conical tip cylinder having a plurality of dispensing openings configured to puncture the container to create a dispensing hole;

a rotatable snap cover with a living hinge having ends connected to each side of the central track, configured to pivot and snap into a closed position to cover the dispensing hole; and a second portion of the central track comprising an opening.

11. The lid of claim 10, wherein the lid comprises an interchangeable disc configured to selectively cover and uncover the dispensing hole.

12. The lid of claim 10, wherein the first portion of the lid comprising a protruding chamber comprising the plurality of dispensing openings is located opposite from the second portion of the lid.

13. The lid of claim 10, wherein the protruding chamber comprising the plurality of dispending openings is configured to puncture a top layer of a container to cause a substance to be dispensed when the container is tilted.

14. The lid of claim 10, wherein the snap cover is in a locked position when the protruding chamber comprising the plurality of dispensing openings is located inside the container.

15. The lid of claim 10, wherein the lid transforms a standard 26 oz salt cardboard canister into a shaker and pour dispenser.

16. The lid of claim 10, wherein the conical tip cylinder is configured in an angled position inside of the container to prevent moisture ingress.

17. The lid of claim 10, wherein the lid comprises a cutout exposing a built in spout of the container.

18. A dispensing apparatus for use with a container comprising:

a base with a central track configured to be positioned on top of the container;

a first portion of the central track comprising:

a protruding chamber, wherein the protruding chamber comprises a conical tip cylinder having a plurality of dispensing openings configured to puncture the container to create a dispensing hole;

a rotatable snap cover with a living hinge having ends connected to each side of the central track, configured to pivot and snap into a closed position to cover the dispensing hole; and a second portion of the central track comprising an opening.

19. The dispensing apparatus of claim 18, wherein the dispensing apparatus is configured to be deployed by alignment of the second portion opening with a built in spout of the container and downward application onto the container, causing the conical tip cylinder to puncture the container.

20. The dispensing apparatus of claim 19, wherein the puncture creates a dispensing hole to be used with the dispensing apparatus in a first configuration for shaking a substance from the container.

* * * * *